United States Patent [19]

Gérard

[11] Patent Number: 5,054,184

[45] Date of Patent: Oct. 8, 1991

[54] PROCESS AND APPARATUS FOR HOT SHAPING OF METALS OR METAL ALLOYS

[75] Inventor: Jacques Gérard, Venarey Les Laumes, France

[73] Assignee: Valinox, Paris, France

[21] Appl. No.: 328,085

[22] PCT Filed: May 26, 1987

[86] PCT No.: PCT/FR88/00267

§ 371 Date: Jan. 30, 1989

§ 102(e) Date: Jan. 30, 1989

[30] Foreign Application Priority Data

May 29, 1987 [FR] France ..... 87 07837

[51] Int. Cl.[5] ..... B23P 17/00

[52] U.S. Cl. ..... 29/423; 29/527.6; 29/424; 228/156

[58] Field of Search ..... 29/DIG. 47, 527.6, 423, 29/424, 417, 527.1, 527.2, 527.3; 72/272, 264; 228/156

[56] References Cited

U.S. PATENT DOCUMENTS

| | | | |
|---|---|---|---|
| 3,160,951 | 12/1964 | Markert et al. | 228/118 |
| 3,350,907 | 11/1967 | McDonald et al. | 72/38 |
| 3,584,368 | 6/1971 | Sargent, Jr. | 29/424 |
| 3,657,804 | 4/1972 | Krock et al. | 29/527.7 |

FOREIGN PATENT DOCUMENTS

| | | |
|---|---|---|
| 1246808 | 10/1960 | France . |
| 1286145 | 9/1962 | France . |
| 835261 | 5/1960 | United Kingdom . |
| 1069742 | 5/1967 | United Kingdom . |

*Primary Examiner*—Joseph M. Gorski
*Assistant Examiner*—S. Thomas Hughes
*Attorney, Agent, or Firm*—Oblon, Spivak, McClelland, Maier & Neustadt

[57] ABSTRACT

The process and apparatus concern hot shaping by plastic deformation of metal alloys by means of a pressing tool.

The process comprises effecting extrusion of a billet which is covered by at least one external sleeve, by a pushing force applied by means of a pressing tool, through a die. A thin layer of at least one compound comprising oxygen and at least one metal is deposited on one of the facing walls of the sleeve and the billet. The billet is preheated before being put into the container for the extrusion operation. Lubrication is effected by a lubricant such as a glass. The process is applied to the extrusion of solid or hollow billets of refractory alloys and also other alloys which involve difficulties in shaping them.

51 Claims, 2 Drawing Sheets

PROCESS AND APPARATUS FOR HOT SHAPING OF METALS OR METAL ALLOYS

BACKGROUND OF THE INVENTION

The process and the apparatus in accordance with the present invention concern hot shaping by plastic deformation of metal alloys by means of a pressing tool.

This process and apparatus concern in particular metal alloys which have a high level of resistance to deformation at elevated temperatures, in association with a low degree of ductility. They also concern metal alloys which have a relatively low level of resistance to deformation at the shaping temperature but which after shaping have numerous surface flaws which are harmful from the point of view of subsequent use thereof.

DESCRIPTION OF THE RELATED ART

The method of extrusion is known, which permits a large number of metals or metal alloys to be shaped by means of a pressing tool.

That method is known to consist of subjecting a billet formed by a metal or metal alloy and disposed in a container, also referred to as the pressing pot, to the thrust force of a pressing piston, with the billet having been preheated to the desired temperature. By virtue of a sufficient pushing force, the billet is extruded through a die which is connected to the end of the container. Bars are produced by the extrusion of solid billets. It is also possible to effect extrusion of hollow billets, that is to say billets which have a hole passing entirely therethrough. That situation involves using a piston provided with a needle or mandrel which engages into the hole in the billet and into the die. As in the case of a solid billet, it is possible to extrude the hollow billet which has been suitably preheated by virtue of a sufficient thrust force so as to cause flow thereof by plastic deformation between the needle or mandrel and the die, in the form of a tube.

It is also known that it is possible to effect an expansion operation prior to extrusion of a hollow billet. The aim of that expansion operation, which is also performed by hot shaping using a pressing tool, is to increase the diameter of the hole without a major loss of material prior to the extrusion operation. For that purpose the hollow billet which is preheated to a suitable temperature is disposed in a container without a die and a needle or mandrel which is of a larger diameter than the hole in the billet is pushed into the hole by the pressing piston. That results in an increase in the diameter of the hole and in most cases an increase in the length of the billet, the outside diameter of which is limited by virtue of that of the container. The billet is therefore driven back in the opposite direction to the direction of displacement of the needle or mandrel.

The extrusion operation and also the expansion operation if included are effected at temperatures which depend on the characteristics of the metals or metal alloys used. In the case of refractory or stainless steels, and other refractory alloys, the shaping temperature range exhibits a lower limit which in most cases is of the order of 900° C., both in regard to extrusion and expansion. Glasses are almost exclusively used as a lubricant, the composition of the glasses being adjusted so that they present the appropriate degree of viscosity, in the temperature range in which extrusion or expansion of a given metal alloy is to be effected.

Although glass-base lubricants thus permit a very large number of metals or metal alloys to be extruded, there are however metal alloys including stainless or refractory steels which remain unsuitable for hot shaping under those conditions. They are metal alloys forming part of the category comprising at least one base component belonging to the group including Fe, Ni, Co and Mo, the hot shaping of which, under the conditions which have just been defined, remains very difficult. Among such metal alloys, mention may be made of refractory alloys and in particular those comprising substantial additions of elements such as chromium and tungsten. Any major plastic deformation of the latter alloys, by extrusion or expansion, is accompanied by the formation of cracks which are often deep and which can make the product useless or at least can involve serious losses of material. For other metal alloys which fall in the same category, which is the case in particular of ferritic chromium steels, in spite of enjoying a relatively low level of resistance to deformation and lubrication which is adapted to the extrusion or expansion temperature, it is found that the resulting product suffers from many surface flaws such as encrustations or inlays which in most cases mean that the product cannot be used as it is. It would then be necessary to carry out expensive preparation or repair operations on the wall surfaces of such products, which is for example particularly difficult and expensive when considering the inside surfaces of tubes.

SUMMARY OF THE INVENTION

The attempt has been made to develop a process and an apparatus for effecting hot shaping by extrusion and, if appropriate, also by expansion, of such metal alloys, by suppressing both the formation of cracks and the formation of surface flaws of the types which have just been described above. The process and the apparatus in accordance with the present invention make it possible to achieve such results.

The process is applied generally to shaping at a temperature which is at least equal to 900° C. by extrusion or by expansion generally followed by an extrusion operation by means of a pressing tool, of a solid or hollow billet of a metal alloy including at least one base component belonging to the group comprising Fe, Ni, Co and Mo. The metal alloys to which the process is applied essentially comprise within the category which is defined in that way, stainless or refractory steels as well as alloys other than steels which are refractory and/or resistant to corrosion.

In accordance with the process according to the invention, there is produced an external tubular metal sleeve whose dimensions are such that it can surround with clearance the external lateral wall of the billet.

A covering layer of at least one compound comprising at least oxygen and at least one metal from the group comprising Al, Ca, Mg, Si, Ti, Zr, Hf, Cr, Ta and Nb is deposited on one at least of the two walls of the billet and the external sleeve, which will be in facing relationship. The thickness of the covering layer is at least 0.05 mm and its melting temperature is higher than the temperature for shaping by extrusion or by expansion.

The billet is then surrounded by the external sleeve and then the front end of the billet is directly or indirectly fixed with respect to the corresponding end of the external sleeve, the other end of the sleeve being free in parallel relationship with the axis of the billet with respect to the rearward end zone thereof. The assembly which is produced in that way is then heated at a temperature which is at least equal to 900° C. and which is suited to the characteristics of the metal alloy which constitutes the billet, and then the extrusion operation or the expansion operation is effected by means of a pressing tool, the sleeved billet being disposed in a container, with the use of a suitable lubricant such as a glass.

Preferably the billet, its sleeve and the container are of a rotationally symmetrical shape.

Preferably, in the case of a hollow billet, prior to expansion and/or prior to extrusion, in addition to the external sleeve an internal tubular metal sleeve is also prepared, which is suitable for being disposed in the hole in the billet so that it can be surrounded by the internal wall surface of the hole, with clearance; a covering layer formed by at least one compound comprising at least oxygen and at least one metal from the group comprising Al, Ca, Mg, Si, Ti, Zr, Hf, Cr, Ta and Nb is deposited on one at least of the two wall surfaces which will be disposed in facing relationship of the hole in the billet and the internal sleeve. The thickness of the covering layer is at least 0.05 mm and its melting temperature is higher than the temperature for shaping by expansion and/or extrusion; the internal sleeve is mounted within the hole in the billet and the front end of the billet is indirectly or directly fixed with respect to the corresponding end of the internal sleeve, the other end of which remains free in the axial direction.

Extrusion or expansion of the billet which is covered in that way is then effected, in the manner already described, with the sleeved billet having been preheated to a suitable temperature which is at least equal to 900° C. and the pressing piston being provided with a needle or mandrel of dimensions which are suited to the extrusion or expansion operation which is to be carried out. The sleeved billet is likewise disposed in a container, the end of which comprises a die in the case of an extrusion operation. It does not have a die when the operation to be performed is an expansion operation.

Advantageously, when it is proposed that a hollow billet is to be subjected to an expansion operation, the hole which is formed through the billet is produced in such a way that it has a flare portion at the front of the billet. After positioning of a front plate which is itself provided with an orifice substantially in line with the flare portion of the hole in the billet, and at least one external sleeve, the expansion operation is effected by introducing the front end of a needle of a diameter which is larger than that of the hole in the billet into the hole, from the front flared end of the billet, by means of the pressing tool, the front end of the needle comprising an engagement zone of smaller diameter, while the sleeved billet is itself disposed in a container whose internal diameter is preferably a little larger than the external diameter of the external sleeve. A suitable lubricant such as a glass is used.

When, in accordance with the invention, extrusion of a billet is effected, the billet which is provided with at least one external sleeve is introduced into a container in such a way that its front end is directed towards the extrusion die, with the piston of the pressing tool applying its thrust force to the rearward end of the billet directly or indirectly against a rearward plate which is itself fixed with respect to the rear of the billet.

When extrusion of a hollow billet is effected, the piston is provided with a needle or mandrel which penetrates into the hole in the billet, extrusion taking place between the needle or mandrel and the die. Preferably also, the billet comprises a rearward plate apertured with a hole which is aligned with the hole in the billet so that the needle or mandrel passes through the hole in the rearward plate and then that in the billet, with the piston applying its thrust force to the rearward plate which is itself fixed with respect to the rear of the billet. Lubrication is effected in known manner for example by a glass of suitable viscosity.

The invention also concerns an apparatus for shaping a hollow or solid billet of a metal alloy, at a temperature which is at least equal to 900° C., by means of a pressing tool, by extrusion or by expansion generally followed by an extrusion operation. In accordance with the invention the metal alloy which forms the billet comprises at least one base component belonging to the group comprising Fe, Ni, Co and Mo. Still in accordance with the invention, within the above-defined range of composition, the metal alloy forming the billet is a stainless or refractory steel or an alloy, other than steel, which is refractory or resistant to corrosion. The apparatus comprises at least one external tubular metal sleeve which surrounds with clearance the external lateral wall of the billet, at least one of the two walls in facing relationship of the billet and the sleeve being provided with a covering layer of at least one compound comprising at least oxygen and at least one metal from the group comprising Al, Ca, Mg, Si, Ti, Zr, Hf, Cr, Ta and Nb. The thickness of the covering layer is at least 0.05 mm and its melting temperature is higher than the extrusion or expansion temperature intended for the billet. A first front connecting means directly or indirectly provides for a connection between the front end of the billet and the corresponding end of the external sleeve, the other end of the sleeve being free in parallel relationship with the axis of the billet with respect to the rearward end zone thereof. Preferably the first connecting means comprises at least one annular weld bead.

Advantageously, the covering layer used is an alumina-base layer which can be produced for example by spraying using an oxyacetylene torch.

Advantageously, a front plate is disposed at the front of the billet, the first front connecting means thus directly or indirectly forming the connection between the front plate, the front of the billet and the external sleeve. Advantageously also the billet is extended at the rear by a rear plate, at least one rear connecting means providing a connection between the rearward end of the billet and the rear plate, the length of the external sleeve being so determined that at least a part of the lateral wall of the rear plate is not covered by the sleeve.

Preferably the billet, at least the external sleeve and the front and rear plates if the latter are used are of a rotationally symmetrical shape.

When the billet is hollow, it preferably comprises an internal tubular metal sleeve, the external wall of which is surrounded with clearance by the lateral wall of the axial hole which passes through the billet. At least one of the two walls in facing relationship of the billet and the sleeve is provided with a covering layer of at least one compound comprising at least oxygen and at least one metal from the group comprising Al, Ca, Mg, Si, Ti, Zr, Hf, Cr, Ta and Nb, the melting temperature of that layer being higher than that intended for the expansion operation or the extrusion operation and the thickness of the layer being at least 0.05 mm. A second front connecting means such as at least one annular weld bead permits a connection to be made directly or indirectly between the front end of the billet and the corresponding end of the internal sleeve, the other end of which is free with respect to the rearward end zone of the billet.

Advantageously, the sleeve or sleeves are made of a non-alloyed or weakly alloyed steel. For certain uses, in particular for the extrusion of a billet of ferritic chromium steel, an external sleeve of austenitic stainless steel is advantageously used.

Advantageously also, the front plate is of a metal or alloy whose resistance to plastic deformation is lower than that of the billet, under the temperature conditions under which the hot shaping operation is performed.

The rear plate is preferably of a metal or alloy whose resistance to plastic deformation is greater than that of the front plate under the conditions of temperature under which the hot shaping operation is performed.

The following examples and drawings will permit the main features of the process and the apparatus in accordance with the invention to be better appreciated, without limiting same.

Example 1: this Example concerns using the process and the apparatus according to the invention for producing a bar by extrusion of a solid billet of refractory alloy.

DESCRIPTION OF THE PREFERRED EMBODIMENTS

Figure 1:
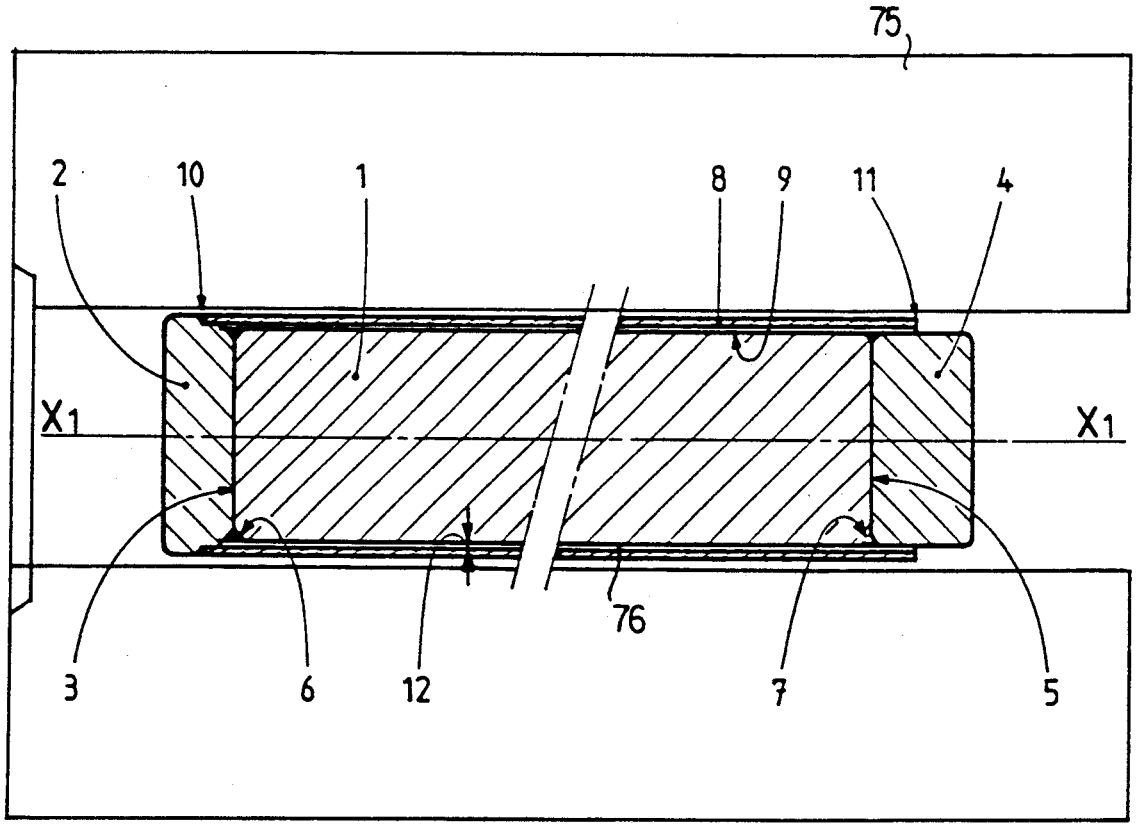
FIG. 1 is a diagrammatic view in section of a solid billet provided with the apparatus according to the invention.

FIG. 1 is a diagrammatic view in section of a solid rotationally symmetrical billet 1 of refractory alloy, with its axis indicated at X1—X1 and a container 75. A front plate 2 which is also rotationally symmetrical with respect to the same axis bears against the front end 3 of the billet 1. A rear plate 4 which is rotationally symmetrical with respect to the same axis bears against the rearward end 5 of the billet. A sleeve 8 surrounds the rotationally symmetrical wall 9 of the billet. Its length is limited so that it covers only approximately half the rear plate 4. A first front connecting means comprises an annular weld 6 which connects the billet 1 to the front plate 2 and an annular weld 10 which connects the front end of the sleeve 8 to the front plate 2. The rearward end 11 of the sleeve 8 leaves exposed a part of the rotationally symmetrical wall surface of the rear plate 4. A rear connecting means comprises an annular bead 7 connecting the rear plate 4 to the billet 1. By virtue of the radial clearance 12, the sleeve can slide on the billet with a relative movement in parallel relationship with the axis X1—X1 from its front end 10 which constitutes the only fixed attachment point thereof. Deposited on the sleeve is a covering layer 76 of a compound comprising oxygen and a metal in the above-defined group. In the present case, the layer is made of alumina ($Al_2O_3$) which was deposited by a known oxyacetylene torch spraying method. The layer remains solid at the extrusion temperature, while breaking up and thus preventing welding by diffusion of the sleeve to the billet during the extrusion operation, which therefore facilitates relative movements of the sleeve and the billet. It also reduces thermal losses at the wall of the billet which thus retains its ductility. By virtue of that combined action on the part of the sleeve and the covering layer deposited thereon, it is found that the bar obtained by extrusion of a billet prepared in the above-indicated manner is devoid of cracks or splits of greater or lesser depth, and has an excellent surface condition.

In that way, extrusion is effected in respect of a solid billet 1 of a Ni-base refractory alloy, Hastelloy C276 (Registered Trade Mark of Cabot), the composition of which is approximately as follows, in percent by weight: Cr 15; Mo 16; W 4; Fe 5.5; and Ni balance.

An external sleeve 8 of mild steel in accordance with the standard A37 (French Standard) is used. The front plate 2 is of stainless steel in accordance with standard Z 2 CN 18-10 and the rear plate 4 is of Z 2 CND 17-12 (also a French Standard), so as to present a higher level of resistance to plastic deformation than the front plate. In the cold condition the clearance between the sleeve coated with its layer of alumina and the billet is approximately 1 to 1.5% of the radius of the billet to take account of the coefficient of expansion of C276, which is almost double the coefficient of expansion of A37.

The extrusion operation is performed at a billet temperature of about 1200° C. Lubrication is effected continuously in known manner by means of a glass of a composition which is suited to those temperature conditions. In that way it is possible, by using dies of suitable configuration, to produce bars of various, circular or non-circular sections, with degrees of reduction of the order of 4 to 8, or greater.

After extrusion the bar produced remains covered by the sleeve which has been thinned down. In fact, the steel A37 constituting the external sleeve is suited to plastic deformation up to temperatures which are much lower than those at which the alloy C276 is still transformable. That explains why the sleeve can undergo plastic deformation without the formation of cracks in the course of the extrusion procedure although the presence of the layer of alumina limits the flow of heat away from the billet towards the sleeve and therefore promotes a substantial reduction in the temperature of the sleeve due to a flow of heat through the container. Moreover the result of the length of the sleeve which is voluntarily reduced so that prior to extrusion it covers only a part of the rear plate is that the thrust force of the piston is applied solely to the billet by way of the rear plate. That results in extrusion through the die being initiated under optimum conditions, the sleeve being stretched over its entire length from its region 10 in which it is connected to the front plate 2 and therefore indirectly to the front of the billet.

The layer of alumina constitutes a highly effective barrier to diffusion of the elements which make up the sleeve, in particular carbon, towards the billet.

By virtue of the layer of alumina also, the sleeve is not welded to the bar and various mechanical, chemical or other means may be used to remove it. In particular it can be widened by transverse rolling in the case of a bar of circular section, thus facilitating stripping the sleeve from the bar. It is also possible to dissolve it selectively by suitably selected acid baths. In certain cases, prior to removal of the sleeve, it is also possible to carry out cold reduction operations, for example by rolling, hammering or drawing, making use of the ductility of the sleeve. It is possible to make those operations easier to perform by subjecting the sleeve to a treatment for fixing a lubricant by a suitable process such as phosphatation.

As stated hereinbefore, after removal of the sleeve, with or without an additional cold reduction operation, the product has an excellent surface condition which is smooth and without crasks and without flaws such as encrustations or the like.

Example 2: This Example concerns use of the process and the apparatus according to the invention for producing a tube by extrusion of a hollow billet.

Figure 2:
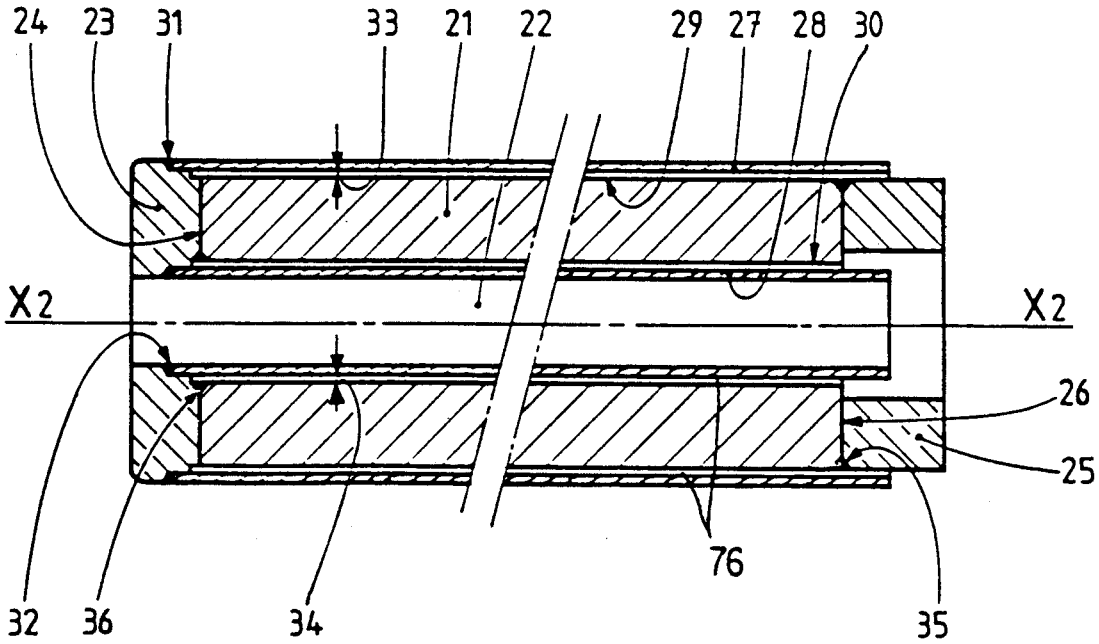
FIG. 2 is a diagrammatic view in section of a hollow billet provided with the apparatus according to the invention for a direct extrusion operation.

FIG. 2 is a view in section of a hollow billet 21 which is rotationally symmetrical with respect to the axis X2—X2, and provided with an axial hole 22. An annular front plate 23 which is rotationally symmetrical with respect to the axis bears against the front end 24 of the billet. An annular rear plate 25 which is also rotationally symmetrical with respect to the axis of the billet bears against the rearward end 26 thereof. An external sleeve 27 surrounds the external wall surface 29 of the billet. An internal sleeve 28 is surrounded by the internal wall surface 30 of the axial hole 22. A first front connecting means comprises an annular weld 36 which connects the billet 21 to the front plate 23 and an annular weld 31 which connects the front end of the external sleeve 27 to the front plate 23. A second front connecting means comprises an annular weld 32 connecting the front end of the internal sleeve 28 to the front plate 23. A rearward connecting means is formed by an annular weld 35 connecting the plate 25 to the billet 21.

A hollow billet of that kind is made of alloy INCO 718 (Registered Trade Mark of Huntington), the composition of which is substantially as follows, in percent by weight: Ni+Co 52; Cr 18; Mo 3; Nb 5; and Fe 19. The outside diameter of the billet is 206 mm and it has an axial hole which is 110 mm in diameter. It is covered with an external sleeve 27 and an internal sleeve 28 of steel A36, of a thickness of 5 mm.

The front and rear plates are made from stainless steel of the same compositions as those used in Example 1. On the face which is towards the corresponding lateral wall of the billet, each of the two sleeves is covered with a layer of alumina 76 which is 0.3 mm in thickness and which is produced by spraying. In order to take account of the ratio between the coefficient of expansion of INCO 718 which is close to that of Hastelloy C276, and the coefficient of expansion of A37, that ratio being close to 2, a radial clearance in the cold condition of about 1.5 mm is provided at 33 between the external sleeve and the billet and a radial clearance, also in the cold condition, of about 0.5 mm, is provided at 34 between the internal sleeve and the billet. As shown in FIG. 2, the two sleeves are of a length such that their rearward ends cover only approximately half the rear plate 25. Thus when the piston applies its thrust force to the rear plate and upon initiation of extrusion of the billet which is sleeved in that way between the die and the needle or mandrel which is carried by the piston and which is 95 mm in diameter, the two sleeves are stretched over their entire length from their regions in which they are connected to the front plate, the layer of alumina promoting relative movements by sliding between the sleeves and the surfaces of the billet which are towards same. After preheating of the sleeved billet to 1100° C., the extrusion operation is performed in a container which is of an inside diameter of 232 mm and which is provided with a die producing a rough-extruded tube which is about 125 mm in outside diameter. As in the case of the first example, lubrication is effected in per se known manner by means of a glass which is deposited in powder form on the side walls of the sleeved and preheated billet and within the axial hole in the billet. After extrusion and removal of the external and internal sleeves, for example by selected dissolution in a suitable acid, the result obtained is a tube with an excellent surface condition which is smooth and without cracks and free from other flaws such as encrustation. As in the case of Example 1, it is found that the presence of the layer of alumina between the sleeves and the billets prevents the formation of diffusion zones. The tube produced is about 123 mm in outside diameter, with a thickness of 13 mm, corresponding to a reduction ratio of about 5.3 as between the initial section of the billet and the section of the tube produced.

Example 3: The process and the apparatus according to the invention are used for expansion prior to extrusion of a hollow billet.

Figure 3:
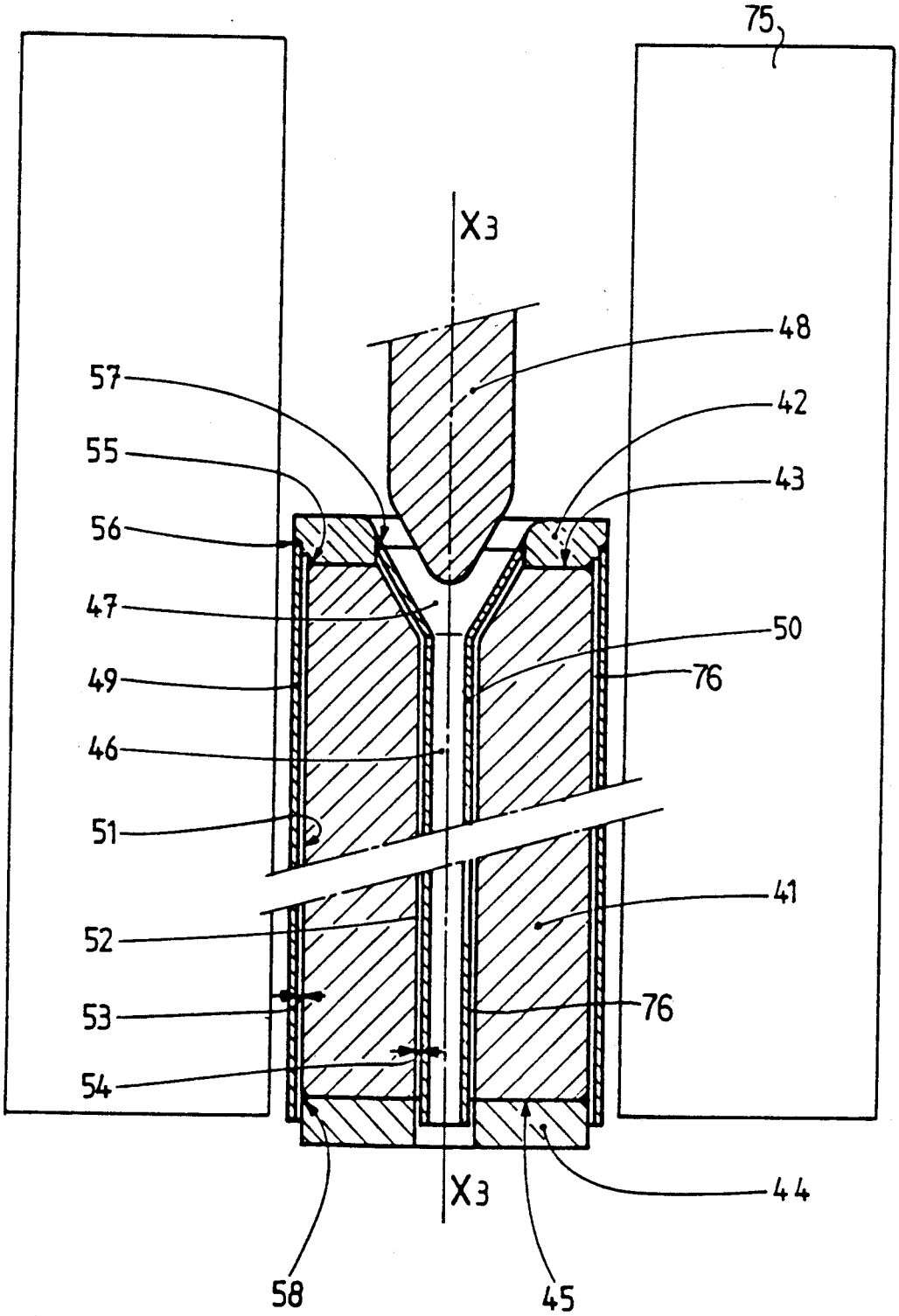
FIG. 3 is a diagrammatic view in section of a hollow billet provided with the apparatus according to the invention for an expansion operation.

FIG. 3 diagrammatically shows a view in section of a hollow billet 41 which is rotationally symmetrical and made of a refractory alloy, with the axis thereof being indicated at X3—X3. An annular front plate 42 which is rotationally symmetrical with respect to the axis bears against the front end 43 of the billet. An annular rear plate 44 which is rotationally symmetrical with respect to the axis bears against the rearward end 45 of the billet. The hollow billet comprises an axial hole 46 which is rotationally symmetrical and which passes entirely through the billet. At the front of the billet, the hole has a flared entrance zone 47 which permits engagement therein of the needle or mandrel 48 which will be pushed through the hole 46 by the pressing tool (not shown). In accordance with the invention the external and internal sleeves 49 and 50 respectively cover the external and internal side walls 51 and 52 respectively of the billet, with radial clearances at 53 and 54. A first front connecting means comprises an annular weld 55 connecting the billet 41 to the front plate 42 and an annular weld 56 connecting the front end of the external sleeve 49 to the front plate. A second front connecting means comprises an annular weld 57 connecting the front end of the internal sleeve 50 to the front plate 42. A rear connecting means is formed by an annular weld 58 connecting the rear plate 44 to the billet 41.

In that way a hollow billet 41 of Hastelloy C276 of a composition identical to that set forth in Example 1 is expanded. The sleeves 49 and 50 which are 5 mm in thickness are of steel A37 and the front and rear plates 42 and 44 are respectively made of the same stainless steels as the front and rear plates 2 and 4 used in Example 1. Each of the two sleeves 49 and 50 is covered on its face which is towards the corresponding lateral wall surface of the billet with a layer of alumina 76 which is produced by spraying and which is 0.3 mm in thickness. The outside diameter of the billet is 250 mm. The radial clearance 53 in the cold condition between the external sleeve 49 and the billet is 1.8 mm and the radial clearance 54 in the cold condition between the internal sleeve 50 and the billet is 0.5 mm. The length of the two sleeves is so limited that their rearward end covers only approximately half the thickness of the rear plate 44. The diameter of the cylindrical portion of the hole 46 is 60 mm and the diameter of the cylindrical portion of the needle or mandrel 48 is 120 mm. The billet 41 which is sleeved in that way is preheated to 1200° C. and disposed in a container 75 with an inside diameter of 270 mm, after the outside wall surface of the external sleeve 49 and the inside wall surface of the internal sleeve 50 have been covered with a layer of glass powder of suitable composition. The needle or mandrel 48 is then pressed through the hole 46 in the billet 41 by means of a pressing tool to cause expansion of the billet. At the same time that produces an increase in the inside diameter of the billet and elongation thereof in the opposite direction to the direction of displacement of the needle or mandrel. A second operation, still in accordance with the invention, comprises extruding the billet which is expanded in that way. The extrusion operation can be carried out using the same sleeves or with those sleeves being replaced by fresh sleeves. When the sleeves are replaced in that way, the surfaces of the billet which has been subject to the expansion operation are found to have an excellent surface condition.

Example 4: The process and apparatus according to the invention are also used for hot shaping of billets of ferritic chromium stainless steel such as in particular the steel containing 17% of chromium, stabilised with titanium, and the steel containing 29% of Cr and 4% of Mo, also stabilised with titanium.

Tests have revealed the possibility of producing tubes by extrusion and/or expansion of hollow billets. Preferably, a single external sleeve of stainless steel of type Z 2 CN 18-10 is used, the front end thereof being directly connected to the front end of the billet by an annular weld bead. The sleeve which is 5 mm in thickness is internally covered with a layer of alumina which is 0.3 mm in thickness. The radial clerance in the cold condition between the sleeve and the billet is limited to 0.5 mm. The front plate and the internal sleeve are of no use having regard to the low level of resistance to deformation of that steel at the extrusion temperature. The rear plate is made of steel Z 2 CND 17-12 whose resistance to deformation is greater than that of the steel of the billet at the extrusion temperature.

It is also possible to effect piercing of a solid billet of ferritic steel containing 17% of chromium of type Z 2 C 17 Ti (French Standard) of an outside diameter of 200 mm. After a rear plate and a sleeve covered with a layer of alumina have been set in position, the sleeved billet is heated to 1050° C., covered with a glass of suitable viscosity and disposed in a container.

A piercing operation is then performed, to produce a diameter of 106 mm, by means of an axial punch. After controlled reheating, the billet is disposed in a container provided with a die for producing a tube of an outside diameter of 118 mm. The billet is pushed through the die by means of a pressing tool comprising a piston provided with a needle or mandrel which is adapted to the diameter of the hole in the billet. After extrusion the external sleeve is removed from the tube, for example by transverse rolling. The glass which is present on the internal surface of the tube is removed by known mechanical means. It is found that the tube produced in that way which is about 116 mm in outside diameter and 96 mm in inside diameter exhibits an excellent surface condition free from flaws such as cracks, encrustation or the like.

In the case of ferritic steel, the advantage of the process according to the invention is that of ensuring that the material which is of low plastic strength in the hot condition does not conform to the surface imperfections of the container.

The process and the apparatus according to the invention can be applied to a large number of metal alloys. A very large number of variations may thus be made in regard to carrying out the process or designing the apparatus, without departing from the scope of the invention.

I claim:

1. A process for shaping a billet of a metal alloy comprising, as a base component, at least one element selected from the group consisting of Fe, Ni, Co and Mo, said process comprising the steps of:

inserting said billet in a tubular metal sleeve whose dimensions are such that it surrounds with clearance, an external wall of said billet, wherein at least one of the external wall of said billet and an internal wall of said tubular metal sleeve has deposited thereon a covering layer of a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of said covering layer is higher than a shaping temperature; fixing a front end of said billet to a front end of said sleeve such that a rear end of said sleeve is free to permit relative sliding between said sleeve and at least a rear portion of said billet, and the front end of the billet is fixed with respect to the front end of the sleeve;

heating the billet surrounded by said external tubular metal sleeve to a shaping temperature of at least 900° C.; and extruding said heated billet surrounded by said external tubular metal sleeve by means of a pressing tool in order to shape said heated billet.

2. The process of claim 1, comprising the further step of connecting a front metal plate to said front end of said billet and said front end of said sleeve to indirectly fix said front end of said billet with respect to said front end of said sleeve.

3. The process of claim 1, comprising using a billet which is of a rotationally symmetrical shape.

4. The process of claim 1, comprising using, as said metal alloy, a stainless or refractory steel.

5. The process of claim 1, comprising using, as said metal alloy, a stainless ferritic chromium steel.

6. The process of claim 1, comprising using, as said metal alloy, a non-steel refractory alloy.

7. A process according to claim 1, wherein said billet is a hollow billet, having an axial hole, and wherein said insertion step comprises:

inserting an internal tubular metal sleeve within the hole of said billet, such that said internal tubular sleeve is surrounded by an internal wall of said hole with a clearance, wherein at least one of the internal wall of said hole and an external wall of said internal tubular sleeve has deposited thereon a covering layer of a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of the covering layer is higher than a shaping temperature; and said fixing step further comprises fixing the front end of said billet to a corresponding end of said internal sleeve such that the rear end of said sleeve is free and the front end of said billet is fixed with respect to the corresponding end of the internal sleeve.

8. The process according to claim 7, wherein during the extrusion of said hollow billet, a piston of said pressing tool is provided with a mandrel which penetrates into the hole of said billet, said extrusion occurring between the mandrel and a die.

9. The process of claim 7, comprising the further step of connecting a front metal plate having an axial hole which corresponds to the axial hole of said hollow billet to the front end of said billet and to both the front end of said sleeve and the front end of said internal sleeve to indirectly fix said front end of said billet with respect to said front end of said sleeve and said internal sleeve.

10. The process according to claim 1, wherein said extrusion step further comprises positioning the billet such that the front end of the billet is oriented towards an extrusion die and applying a thrust force with said pressing tool to a rear end of said billet, said pressing tool comprising a piston.

11. The process according to claim 10, comprising the further step of fixing a rear plate to the rear of the billet, said piston of said pressing tool indirectly applying said thrust force to the rear end of said billet by acting against said rear plate.

12. An apparatus for shaping a billet by extrusion by means of a pressing tool, comprising, as a base component, at least one element selected from the group consisting of Fe, Ni, Co and Mo, wherein a shaping temperature for said billet is at least 900° C., said apparatus comprising:

at least one external tubular metal sleeve which surrounds with clearance an external lateral wall of said billet, at least one of the external lateral wall of said billet and an internal wall of said external sleeve being provided with a covering layer of a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of said covering layer is higher than said billet shaping temperature; and a first front connecting means for indirectly connecting a front end of said billet and a front end of said external sleeve;

wherein the front end of the billet is fixed with respect to the front end of the external sleeve and a rear end of said external sleeve is free for permitting a relative sliding movement between said sleeve and at least a rear portion of said billet.

13. The apparatus according to claim 12, further comprising:

a front plate positioned at the front end of said billet; and a second front connecting means for connecting said front plate to the front end of the billet;

wherein said first front connecting means connects the front end of said external sleeve to said front plate and thereby indirectly provides for a connection between the front end of the billet, the front end of the external sleeve and the front plate.

14. The apparatus according to claim 12, wherein said billet has a rotationally symmetrical shape.

15. The apparatus according to claims 13 or 14, wherein the rear of said billet is extended by a rear plate having a section substantially the same as that of said billet, said apparatus further comprising a rear connecting means for connecting the rear end of the billet and the rear plate, said external sleeve having a length such that at least a part of a lateral wall of the rear plate is not covered by said external sleeve.

16. The apparatus according to claim 15, wherein said rear plate is steel.

17. The apparatus according to claim 13, wherein said front plate has a resistance to plastic deformation at the shaping temperature which is lower than that of the alloy which constitutes the billet.

18. The apparatus according to claim 15, wherein said rear plate has a resistance to plastic deformation at the shaping temperature which is higher than that of the front plate.

19. The apparatus according to claim 12, wherein said billet is hollow, said hollow billet comprising an axial hole having a lateral wall, said lateral wall of the axial hole surrounding, with clearance, an external wall of an internal metal sleeve, at least one of said two walls being provided with a covering layer having a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of said covering layer is higher than said billet shaping temperature, wherein a third front connecting means provides for a connection between the front end of the billet and the corresponding end of said internal sleeve, the other end of said internal sleeve being free with respect to the rear portion of the billet.

20. The apparatus according to claim 19, further comprising:

a front plate positioned at the front end of said hollow billet, said front plate comprising an axial hole which corresponds to the axial hole of said hollow billet 21. The apparatus according to claim 12, wherein said billet is of stainless or refractory steel.

22. The apparatus according to claim 21, wherein said billet is of ferritic stainless steel.

23. The apparatus according to claim 12, wherein said billet is of a refractory alloy other than steel.

24. The apparatus according to claim 12, wherein said external sleeve is steel.

25. The apparatus according to claim 12, wherein said external sleeve is austenitic stainless steel.

26. The apparatus according to claim 12, wherein said covering layer is alumina-based.

27. A process for shaping a billet of a metal alloy comprising, as a base component, at least one element selected from the group consisting of Fe, Ni, Co and Mo, said process comprising the steps of:

inserting said billet in a tubular metal sleeve whose dimensions are such that it surrounds with clearance, an external wall of said billet, wherein at least one of the external wall of said billet and an internal wall of said tubular metal sleeve has deposited thereon a covering layer of a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of said covering layer is higher than a shaping temperature;

fixing a front end of said billet to a front end of said sleeve such that a rear end of said sleeve is free to permit relative sliding between said sleeve and at least a rear portion of said billet, and the front end of the billet is fixed with respect to the front end of the sleeve;

heating the billet surrounded by said external tubular metal sleeve to a shaping temperature of at least 900° C.; and expanding said heated billet surrounded by said external tubular metal sleeve by means of a pressing tool in order to shape said heated billet.

28. The process of claim 27, comprising the further step of connecting a front metal plate to said front end of said billet and said front end of said sleeve to indirectly fix said front end of said billet with respect to said front end of said sleeve.

29. The process of claim 27, comprising using a billet which is of a rotationally symmetrical shape.

30. The processs of claim 27, comprising using, as said metal alloy, a stainless or refractory steel.

31. The process of claim 27, comprising using, as said metal alloy, a stainless ferritic chromium steel.

32. The process of claim 27, comprising using, as said metal alloy, a non-steel refractory alloy.

33. A process according to claim 27, wherein said billet is a hollow billet, having an axial hole, and wherein said insertion step comprises:

inserting an internal tubular metal sleeve within the hole of said billet, such that said internal tubular sleeve is surrounded by an internal wall of said hole with a clearance, wherein at least one of the internal wall of said hole and an external wall of said internal tubular sleeve has deposited thereon a covering layer of a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of the covering layer is higher than the shaping temperature; and said fixing step further comprises fixing a front end of said billet to a front end of said internal sleeve such that a rear end of said internal sleeve is free and the front end of said billet is fixed with respect to the front end of the internal sleeve.

34. The process of claim 33, comprising the further step of connecting a front metal plate having an axial hole which corresponds to the axial hole of said hollow billet to the front end of said billet and to both the front end of said sleeve and the front end of said internal sleeve to indirectly fix said front end of said billet with respect to said front end of said sleeve and said internal sleeve.

35. The process according to claim 34, wherein for said expansion of said hollow billet, the hole of said billet comprises a flared portion at the front end of said billet, said front end of said billet being extended by the front plate, wherein said expansion takes place by inserting a mandrel into the hole of said billet, from the front flared end thereof, by means of said pressing tool, said mandrel having a larger diameter than the diameter of the hole of said billet and comprising an engagement zone at its front end of a smaller diameter, said hollow billet having said external and internal sleeves being disposed in a container whose internal diameter is slightly larger than the external diameter of the external sleeve.

36. An apparatus for shaping a billet by expansion by means of a pressing tool, said billet comprising, as a base component, at least one element selected from the group consisting of Fe, Ni, Co and Mo, wherein a shaping temperature for said billet is at least 900° C., said apparatus comprising:

at least one external tubular metal sleeve which surrounds with clearance an external lateral wall of said billet, at least one of the external lateral wall of said billet and an internal wall of said external sleeve being provided with a covering layer of a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of said covering layer is higher than said billet shaping temperature; and a first front connecting means for indirectly connecting a front end of said billet and a front end of said external sleeve;

wherein the front end of the billet is fixed with respect to the front end of the external sleeve and a rear end of said external sleeve is free for permitting a relative sliding movement between said sleeve and at least a rear portion of said billet.

37. The apparatus according to claim 36, further comprising:

a front plate positioned at the front end of said billet; and a second front connecting means for connecting said front plate to the front end of the billet;

wherein said first front connecting means connects the front end of said external sleeve to said front plate and thereby indirectly provides for a connection between the front end of the billet, the front end of the external sleeve and the front plate.

38. The apparatus according to claim 36, wherein said billet has a rotationally symmetrical shape.

39. The apparatus according to one of claims 37 and 38, wherein the rear portion of said billet is extended by a rear plate having substantially the same section as said billet, said apparatus further comprising a rear connecting means for connecting the rear portion of the billet and the rear plate, said external sleeve having a length such that at least a part of a lateral wall of the rear plate is not covered by said external sleeve.

40. The apparatus according to claim 36, wherein said billet is hollow, said hollow billet comprising an axial hole having a lateral wall, said lateral wall of the axial hole surrounding, with clearance, an external wall of an internal metal sleeve, at least one of said two walls being provided with a covering layer having a thickness of at least 0.05 mm, said covering layer being formed of a compound which comprises oxygen and at least one metal selected from the group consisting of Al, Ca, Mg, Si, Ti, Zr, Hf, Cr, Ta and Nb, wherein a melting temperature of said covering layer is higher than said billet shaping temperature, wherein a third front connecting means provides for a connection between the front end of the billet and a front end of said internal sleeve, a rear end of said internal sleeve being free with respect to the rear of the billet.

41. The apparatus according to claim 40, wherein the hollow billet comprises a hole which is flared at its front end.

42. The apparatus according to claim 36, wherein said billet is of stainless or refractory steel.

43. The apparatus according to claim 42, wherein said billet is of ferritic stainless steel.

44. The apparatus according to claim 36, wherein said billet is of a refractory alloy other than steel.

45. The apparatus according to claim 36, wherein said external sleeve is steel.

46. The apparatus according to claim 36, wherein said external sleeve is austenitic stainless steel.

47. The apparatus according to claim 39, wherein said rear plate is steel.

48. The apparatus according to claim 37, wherein said front plate has a resistance to plastic deformation at the shaping temperature which is lower than that of the alloy which constitutes the billet.

49. The apparatus according to claim 39, wherein said rear plate has a resistance to plastic deformation at the shaping temperature which is higher than that of the front plate.

50. The apparatus according to claim 36, wherein said covering layer is alumina-based.

51. The apparatus according to claim 40, further comprising:

a front plate positioned at the front end of said hollow billet, said front plate comprising an axial hole which corresponds to the axial hole of said hollow billet.

* * * * *